United States Patent [19]

Ridgeway

[11] Patent Number: 5,071,009

[45] **Date of Patent: * Dec. 10, 1991**

[54] RETAINING AND SHOCK-ABSORBING PACKING INSERT

[76] Inventor: Louis H. Ridgeway, 5835 Leadrope Way, Bonita, Calif. 92002

[ * ] Notice: The portion of the term of this patent subsequent to Aug. 1, 2006 has been disclaimed.

[21] Appl. No.: 579,044

[22] Filed: Sep. 6, 1990

Related U.S. Application Data

[63] Continuation-in-part of Ser. No. 500,384, Mar. 12, 1990, abandoned, which is a continuation of Ser. No. 293,059, Jan. 3, 1989, abandoned, which is a continuation-in-part of Ser. No. 285,449, Dec. 16, 1988, Pat. No. 4,923,065, which is a continuation-in-part of Ser. No. 162,225, Feb. 29, 1988, Pat. No. 4,852,743.

[51] Int. Cl.[5] ..... B65D 81/02; B65D 85/30

[52] U.S. Cl. ..... 206/586; 206/583; 206/521; 206/453

[58] Field of Search ..... 206/485, 521, 583, 586, 206/591, 592, 593, 594, 453

[56] References Cited

U.S. PATENT DOCUMENTS

| | | | |
|---|---|---|---|
| 2,134,908 | 11/1938 | Copeman | 229/28 |
| 2,501,570 | 3/1950 | Larsen | 206/583 |
| 3,404,827 | 10/1968 | Carmody | 206/586 |
| 3,521,743 | 7/1970 | Sposito, Jr. | 206/583 |
| 3,523,863 | 8/1970 | Juhos | 206/583 |
| 3,752,301 | 8/1973 | Bluemel | 206/583 |
| 4,087,003 | 5/1978 | Adamek | 206/583 |
| 4,491,225 | 1/1985 | Baillod | 206/583 |
| 4,852,743 | 8/1989 | Ridgeway | 206/583 |
| 4,923,065 | 5/1990 | Ridgeway | 206/583 |

FOREIGN PATENT DOCUMENTS

| | | | |
|---|---|---|---|
| 52-49461 | 11/1978 | Japan . | |
| 135796 | 11/1978 | Japan | 206/583 |
| 827346 | 9/1979 | U.S.S.R. | 206/583 |
| 1006318 | 3/1983 | U.S.S.R. | 206/586 |
| 475299 | 11/1937 | United Kingdom | 206/583 |
| 1224493 | 3/1971 | United Kingdom | 206/586 |

*Primary Examiner*—David T. Fidei
*Attorney, Agent, or Firm*—Henri J. A. Charmasson

[57] ABSTRACT

Two or more packing spacers support an object within its shipping container in a floating arrangement that absorbs shocks, and flexion and torsion of the container due to shipping and handling loads. Each spacer is a structure with a frame-window covered with a flexible membrane of high tensile strength. The object is frictionally held between the membranes. The spacers are shaped and dimensioned to match the internal geometry of the container and to determine the space between the membranes occupied by the object. Spacers with large contact areas between their membranes and the object can hold and cushion objects of very high densities.

8 Claims, 2 Drawing Sheets

FIG. 1
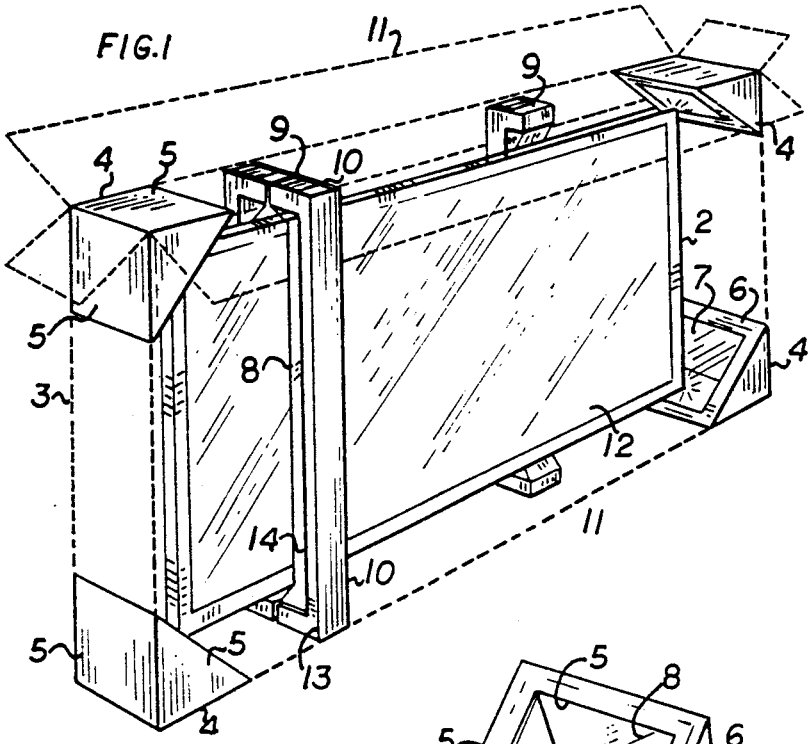
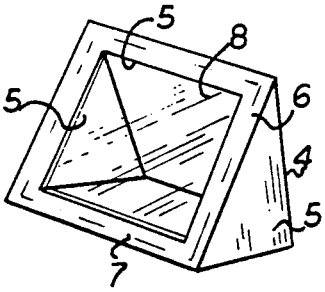
FIG. 2
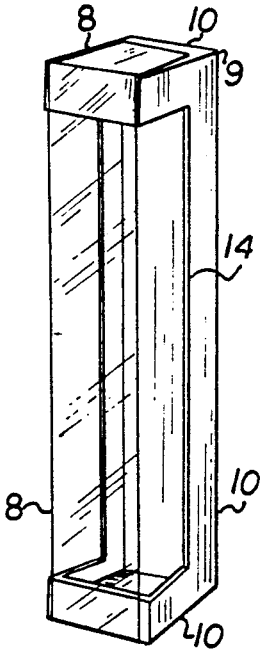
FIG. 3
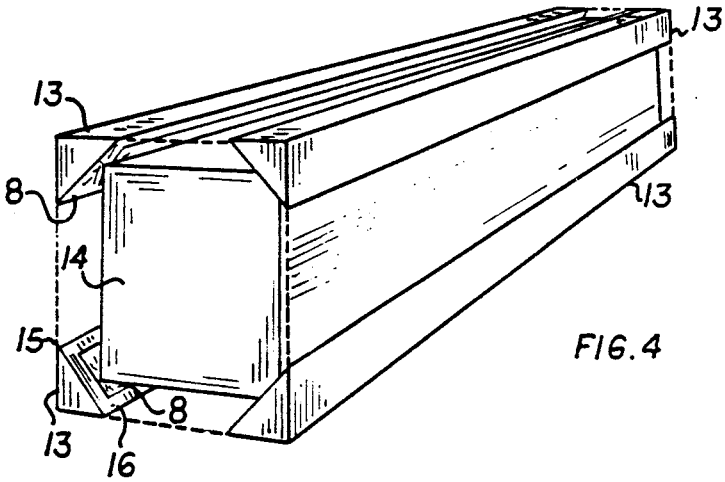
FIG. 4

RETAINING AND SHOCK-ABSORBING PACKING INSERT

PRIOR APPLICATION

This is a continuation-in-part application of abandoned co-pending application Ser. No. 07/500,384 filed Mar. 12, 1990 which is a continuation of abandoned application Ser. No. 07/293,059 filed Jan. 3, 1989 which was a continuation-in-part of application Ser. No. 07/285,449 filed Dec. 16, 1988, now U.S. Pat. No. 4,923,065 which was a continuation-in-part of application Ser. No. 162,225 filed Febr. 29, 1988 now U.S. Pat. No. 4,852,743.

1. Field of the Invention

This invention relates to packaging material, and more specifically to packing inserts using stretchable and/or pliable membranes to suspend and cushion objects within a container.

2. Background of the Invention

Suspending membranes have been used in the past in lieu of resilient inserts and filling material to hold and cushion objects within a container. Before my inventions disclosed herein and in U.S. Pat. No. 4,852,743 and U.S. Pat. No. 4,923,065, this type of packing was exclusively indicated for light and delicate objects such as horological parts as disclosed in U.S. Pat. No. 4,491,225 Baillod. The resilient stretchability of the membrane itself was thought to provide the bulk of the shock-absorbing process. This is particularly illustrated in U.S. Pat. No. 2,134,908 Copeman which teaches the use of elastic membranes which are stretched over opposite sides of a fragile object such as an egg to provide cushioning against loads incident upon the parallel planes of the unstretched membrane. No cushioning against lateral movements of the object along directions generally parallel to the planes of the membrane was provided by the membranes. That type of movement was restricted either by the edges of the apertures over which the membranes were stretched or by resilient separators made of various materials. In U.S. Pat. No. 4,491,225 the object is supported above a void by a first horizontal membrane, then covered by a second membrane which is joined to the first membrane along its periphery. The joined edges of the two membranes are supported midway between the top and bottom internal surfaces of the container. The bottom membrane acts as an hammock. That role is taken by the top surface when the container is laid upside down. The elasticity of the membranes provide cushioning against vertical loads. Since the membranes are stretched over the supported object and partially wrapped around some of its convex extremities, lateral impacts are also absorbed by the elastic deformation of the membranes. Japanese Patent No. 135,796 Kondou reveals the same hammock-type suspension technique, but instead of joining the edges of the membrane, it teaches the stretching and mounting of the membranes over two symmetrical halves of an empty container which are then brought together like clam shells to hold the delicate object suspended therebetween.

Due to the elastic quality of the membranes, it was thought that heavy objects could not benefit from this type of packaging a their weight would progressively deform the underlying membrane to a point where the space between the object and the bottom of the container would not be sufficient to absorb expected vertical shocks, or to the extreme situation where the object would come in contact with the floor of the container. My inventions improve the membrane packing techniques of the prior art to a point where they can be applied to the packing of relatively heavy objects.

SUMMARY OF THE INVENTION

The principal and secondary objects of the instant invention are to expand the application of membrane-holding and cushioning techniques to packaging of bulky and heavy objects, and to improve the shock-absorbing capabilities of those techniques in regard to loads along any direction including directions generally parallel to the planes of the supporting membranes.

These and other objects are achieved by using membranes of high tensile strength and limited elasticity, and by controlling the friction between the membrane and the supported items and adjusting the spacing between the supporting membranes to the size and weight of the supported object.

BRIEF DESCRIPTION OF THE DRAWINGS

FIG. 1 is a perspective view of a packing assembly for a picture frame;

FIG. 2 is a perspective view of a shock-absorbing corner insert;

FIG. 3 is a perspective view of a shock-absorbing lateral insert;

FIG. 4 is a perspective view of a packing assembly for a bulky and heavy object;

DESCRIPTION OF THE PREFERRED EMBODIMENTS OF THE INVENTION

Figure 5:
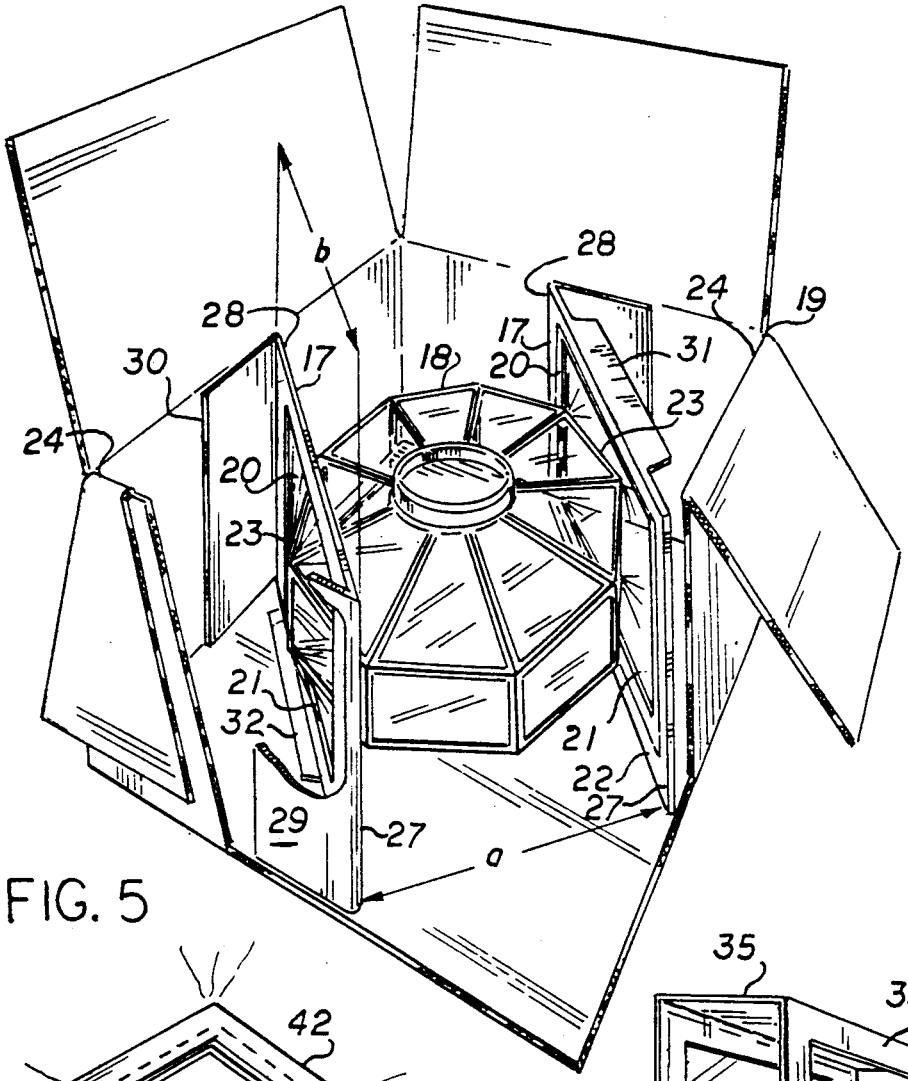
FIG. 5 is a perspective view of a packing assembly using flat, membrane-mounting insert frames.

Referring now to the drawing, a first embodiment of a shock-absorbent packing assembly for a long-flat article such as a glass picture frame 2 will be described. The long, thin external container 3 enclosing the article 2 is shown in phantom for clarity. Each of the four corner spacers or inserts 4 is a box-like, hollow frame cardboard structure having four outer face 5 in intimate contact with the inner surface of the container 3. An opening or port 7 in one of the faces 6 not in contact with the interior surfaces of the container 3 is covered by a pliable membrane or film 8. The film 8 is tightly spread over the opening 7 and bonded to the corner insert 4. Attachment of the membrane 8 to the corner insert 4 may be achieved by means of an adhesive or by the contact properties of the surface of the film 8 to the material of the corner insert 4. The corner inserts 4 having their membranes 8 in contact with the corner of the object 2 act as both an anchor positioning the item in the middle of the container 3, and shock-absorbers.

The membranes are made from a material chosen for its high tensile strength. Material with a slight elasticity are also preferred in order to accommodate sharp edges such as the outside corners of the article 2, and thus prevent puncture or rupture of the membrane. The movement of the article 2 within the container 3, absent any other restraint, are limited to slight resilient deformation of the membranes, and to frictional sliding of the contacting corners against the surfaces of the films. As long as these movements do not bring the article 2 into contact with the edges of the openings 7, loads from any directions are absorbed by frictional displacement.

Lateral inserts 9 are provided to limit and absorb torsional loads. Each of the lateral inserts consist of a multi-faced, rectangular box-like structure having at least one side in intimate contact with the interior surfaces 11 of the container. The lateral inserts are positioned to support the article 2 when the packing container 3 is laid on one of its largest sides 12. In order to cushion the article against loads from a direction normal to said sides 12. Each lateral insert 13 is hollow and has an opening 14 facing the object 2. That opening extends over most of the length of the side facing the object 2 and over approximately half the width of the two adjacent sides of the insert 13. A strip of membrane 8 is tightly spread over the opening 14 and bonded at both ends to the top and bottom 10 of the insert. Lateral forces which are not normal to the larger faces 12 of the article 2 are limited by the frictional contact between those faces and the strips of membrane. When the box is laid down on one of its largest sides, supporting forces, even when the lateral insert is displaced in response to shocks remain evenly distributed along the faces 12 of the article 2.

Each of the corner inserts 4 has four outer surfaces 5 which are shaped and dimensioned for intimate contact with the inside corner surfaces of the container 3 in order to solidly anchor each insert in one corner of the container. The spacings between the ported faces 6 of the corner inserts and between the lateral inserts determine the frictional forces which resist lateral movement of the object within the container 3.

A second embodiment of a shock-absorbing packing assembly specially adapted to heavy and bulky objects is illustrated in FIG. 4. The four corner inserts 13 are similar in construction to the corner inserts 4 illustrated in FIG. 2, but are shaped and dimensioned to fit into the longest internal corners of the container. These corner inserts 13 support a large, bulky article 14 within container 15 shown in phantom with flaps closed for clarity. Each corner insert 13 has outer faces in intimate contact with an inside corner of the container 15 and a larger ported face 16 over which a film 8 is tightly spread and attached. This extended corner type of membrane expansion for large articles or multiple articles of the same size can absorb shock and forces from all directions. The larger frictional bearing contact between the various membranes and the article 14 can accommodate a wide range of static weights and dynamic loads. This type of insert can safely hold and cushion objects of high density and great size compared to the size of the inserts.

The third embodiment of a shock-absorbing packing assembly illustrated in FIG. 5 uses a pair of membrane-mounting planar frames 17 surrounding a void, in lieu of the corner inserts and lateral inserts of the previously described embodiments to position and cushion a relatively heavy object, such as a stained glass lampshade 18, within its shipping container 19. The two identical membrane-mounting frames 17 are made from sheets of corrugated cardboard in which large central windows 20 have been cut. A film 21 is tightly spread over the void of each window and glued to the inner faces 22 of the frames. The face-to-face and relative positions of the frames 17 within the container 19 is adjusted so that the distance a between the frames is less than the width or diameter of the article 18, and to the point where the friction exerted by the films 21 against opposing lateral sections 23 of the article 18 is sufficient to securely hold the article at mid-height in the center of the container 19. Since each frame 17 rests obliquely against two adjacent sides of the box, the distance between a frame and the angle 2 formed by its two supporting sides of the container can be adjusted by varying the width b of the frame. This may be done by trimming one or both sides 27, 28 of the frame, or by folding those sides to increase the width of the lateral flaps 29, 30. The flaps 29, 30 reinforce the rigidity of the frame 17. Top and bottom flaps 31, 32 may also be provided for the same purpose.

In an alternate configuration the lateral flaps 29, 30 could be extended all the way to the angle 24 to set and stabilize the relative position of the frames.

It should be noted that in contrast to the hammock-type of membrane packing system of the prior art, the packaged object 18 does not rest against an underlying horizontal membrane regardless of the face or side on which the container 19 is lying. It is only the friction of the object against the membrane which holds the object and restricts it movement caused by either the static force of its weight or the dynamic forces resulting from loads and shocks which are not normal to the planes of the membranes.

Figure 6:
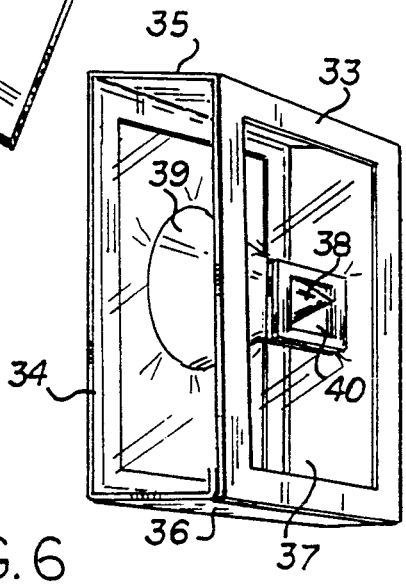
FIG. 6 is a perspective view of an alternate embodiment of the membrane frames.

A different manner for adjusting the spacing between two membrane frames 33, 34 is illustrated in FIG. 6. The spacing is determined by sections of cardboard panels 35, 36 bridging the two frames along their tops and bottom edges respectively.

In order to avoid puncturing of the right side membrane 37 by the sharply pointed tip 38 of the conical object 39 suspended between the two frames 33, 34, a relief hole 40 has been cut into the center of the right membrane 37.

Figure 7:
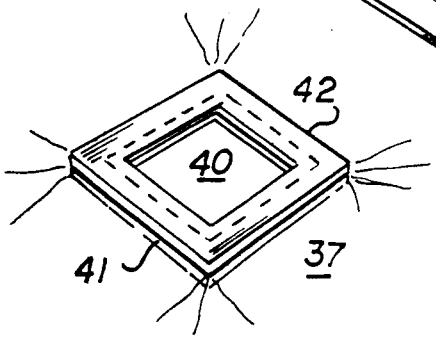
FIG. 7 is a detail perspective view of a puncture relief.

As better illustrated in FIG. 7, the edges of the hole 40 are trapped between two sandwiching cardboard windows 41, 42, the cardboard windows to distribute the stress caused by the protruding tip 38 evenly to the membrane 37 and prevent tearing of the membrane around the hole periphery.

In the various embodiments described above, the membranes are preferably made of polyester grades of polyurethane films in thicknesses varying from 0.05 to 0.5 mm (2 to 20 mils) depending upon the required load. This type of membrane exhibits tensile strength up to 700 kilograms per square centimeter (10,000 p.s.i.). Membranes with tensile strength of at least 280 kilograms per square centimeters (4,000 p.s.i.) are recommended. Membranes made of polyvinylchloride (PVC) films in the same range of thickness can also be used in spite of the fact that their tensile strength is about half that of polyurethane membranes. The PVC material is also more sensitive to extremes in temperature and has a tendency to soften at high temperatures and turn brittle in extreme cold.

Either type of membrane can be bonded to the cardboard inserts or planar frames with a water-based acrylic adhesive. Certain polyurethane films have a surface wax residue which may interfere with the bonding process. This problem can be overcome by washing the bonded area with isopropyl alcohol or trichoroleth-yane.

While the preferred embodiments of the invention have been disclosed, modifications can be made and other embodiments may be devised without departing from the spirit of the invention and the scope of the appended claims.

What is claimed is:

1. In combination with a rigid shipping container, a shock-absorbing assembly for holding an object inside said container which comprises:

at least two spacing elements interposed between the object and generally opposite internal surfaces of said container;

each of said spacing elements defining a planar framing surface surrounded by a void and comprising;

a film of pliable material of high tensile strength tightly spread over said void and peripherally secured to said framing surface; and a central portion of said film being in frictional contact with said object;

said spacing elements being shaped, dimensioned and positioned to place the planar framing surfaces of said spacing elements into a face-to-face and spaced-apart position within said container so that when said planar framing surfaces are held in substantial vertical planes they apply sufficient pressure to the object to frictionally limit any sliding movement of the object against said portions of said films when the object is subject to vertical forces;

each of said spacing elements comprising a hollow, polyhedral box made of cardboard and having at least four planar faces, two of said faces being contiguous and being shaped and oriented to intimately nest into an inside corner of said container; wherein each of said boxes comprises:

an elongated, rectangular polyhedron defining four rectangular, contiguous, long sides capped at opposite ends by top and bottom panels, said box having an opening extending generally over the entire length of a first one of said long sides, and partially over the length of at least one of said long sides adjacent to said first side; and wherein said contiguous faces comprise a side opposite said first long side, and one of said top and bottom panels.

2. The combination of claim 1, wherein said film consists of a sheet of material having a tensile strength of at least 280 kilograms per square centimeter.

3. The combination of claim 2, wherein said film consists of a sheet of polyurethane.

4. The combination of claim 2, wherein said film consists of a sheet of polyvinylchloride.

5. In combination with a rigid shipping container, a shock-absorbing assembly for holding an object inside said container which comprises:

at least two spacing elements interposed between the object and generally opposite internal surfaces of said container;

each of said spacing elements defining a planar framing surface surrounded by a void and comprising:

a film of pliable material of high tensile strength tightly spread over said void and peripherally secured to said framing surface; and a central portion of said film being in frictional contact with said object;

wherein said spacing elements are shaped, dimensioned and positioned to place the planar framing surfaces of said spacing elements into face-to-face and spaced-apart position within said container and to apply sufficient pressure to the object to frictionally limit any sliding movement of the object against said portion of said film when the object is subject to forces generally parallel to the orientation of said portion of one of said films;

wherein one of said films has an opening, and comprises a pair of cardboard frames glued around the periphery of said opening.

6. The combination of claim 5, wherein said film consists of a sheet of material having a tensile strength of at least 280 kilograms per square centimeter.

7. The combination of claim 6, wherein said film consists of a sheet of polyurethane.

8. The combination of claim 7, wherein said film consists of a sheet of polyvinylchloride.

* * * * *